US005166655A

United States Patent [19]

Rogers

[11] Patent Number: 5,166,655

[45] Date of Patent: Nov. 24, 1992

[54] SHIELDED INDUCTOR

[75] Inventor: L. Rodney Rogers, Perrysburg, N.Y.

[73] Assignee: Gowanda Electronics Corporation, New York, N.Y.

[21] Appl. No.: 697,744

[22] Filed: May 6, 1991

Related U.S. Application Data

[63] Continuation of Ser. No. 339,872, Apr. 17, 1989, abandoned, which is a continuation of Ser. No. 156,151, Feb. 16, 1988, abandoned.

[51] Int. Cl.[5] ..... H01F 15/04; H01F 27/26

[52] U.S. Cl. ..... 336/83; 336/84 M; 336/96; 336/212

[58] Field of Search ..... 336/83, 84 R, 84 M, 336/212, 192, 96, 205, 84 C

[56] References Cited

U.S. PATENT DOCUMENTS

| | | | |
|---|---|---|---|
| 1,673,062 | 6/1928 | Davis | 336/83 |
| 1,968,225 | 7/1934 | Shell et al. | 336/83 X |
| 2,413,201 | 12/1946 | Tillman | 336/83 X |
| 2,905,915 | 9/1959 | Harris | 336/83 X |
| 2,933,677 | 4/1960 | Lieber | 336/84 M |
| 2,949,591 | 8/1960 | Craige | 336/83 |
| 2,976,502 | 3/1961 | Hill | 336/83 |
| 3,381,251 | 4/1968 | Fuller | 336/83 |
| 3,551,864 | 12/1970 | Sweeney et al. | 336/83 |
| 3,829,806 | 8/1974 | Lathouwers et al. | 336/83 |
| 4,245,207 | 1/1981 | Murakami et al. | 336/83 X |
| 4,647,892 | 3/1987 | Hewitt | 336/83 |

FOREIGN PATENT DOCUMENTS

| | | | |
|---|---|---|---|
| 1531584 | 7/1968 | France | 336/83 |

*Primary Examiner*—Thomas J. Kozma

*Attorney, Agent, or Firm*—Bradford E. Kile; Ruffin B. Cordell

[57] ABSTRACT

A shielded inductor is formed by winding a coil of wire around an axial leaded form, and disposing a magnetic shield around the axial leaded form and the coil of wire. In a preferred embodiment, the magnetic shield is epoxied to the coil of wire. In a further preferred embodiment, a premold is formed around the axial leaded form and the coil of wire, and the magnetic shield is epoxied to the premold, the premold serving to position the magnetic shield concentrically with respect to the axial leaded form and the coil of wire. In a still further embodiment, the premold is provided with a shoulder against which the magnetic field abuts, thus positioning the magnetic shield along the axis of the axial leaded form.

1 Claim, 1 Drawing Sheet

SHIELDED INDUCTOR

This application is a continuation of application Ser. No. 07/339,872, filed Apr. 17, 1989, now abandoned which is a continuation of Ser. No. 07/156,151, filed Feb. 16, 1988, now abandoned.

TECHNICAL FIELD

The present relates to a shielded inductor and method for fabricating same, and more particularly to an inductor having magnetic shielding in the form of a magnetic sleeve disposed over a coil winding of the inductor. The invention further relates to the provision of a sleeve positioning arrangement and method for a shielded inductor.

BACKGROUND ART

Conventional axial lead inductors consist of a coil of wire wound on an axial leaded form. Such conventional inductors are disclosed in Hill U.S. Pat. No. 2,976,502 and Goldsmith U.S. Pat. No. 3,171,091.

It is considered desirable to provide such inductors with magnetic shielding surrounding the coil winding of the inductor. "Magnetic shielding" is a term of art used to describe a method of enclosing a magnetic field so as to confine its flux, thus preventing interaction with other components or circuits. In the aforementioned Hill patent, a sleeve of finely divided magnetic material is used to enclose a spool and a winding, and serves the function of a magnetic shield. Similarly, in the Goldsmith patent, a layer of high permeability plastic material also functions as a magnetic shield.

It is also considered desirable, in the fabrication of an inductor, to achieve consistent electrical characteristics among the various inductors fabricated. In fact, if variation in the axial and/or radial positioning of the shield of a shielded inductor occurs during the fabrication process, variations in the inductance of the coil and in the degree of shielding will result. This has been considered to be a disadvantageous characteristic of inductors of the prior art.

The following patents are considered to be of background interest relative to the invention disclosed herein: Hill U.S. Pat. No. 2,653,992; Hopkins et al U.S. Pat. No. 2,823,361; Hansen U.S. Pat. No. 3,380,004; Fuller U.S. Pat. No. 3,381,251; Lathouwers et al U.S. Pat. No(s). 3,775,841 and 3,829,806; Kaiserwerth et al U.S. Pat. No. 3,835,370; Sully U.S. Pat. No. 4,170,014; McElheny U.S. Pat. No(s). 4,231,985 and 4,331,946; Hatton U.S. Pat. No. 4,354,310.

DISCLOSURE OF INVENTION

The present invention relates to a shielded inductor and method of fabricating same. More particularly, the invention relates to a magnetically shielded inductor wherein a magnetic sleeve is provided over the outside of a coil winding of the inductor.

Several embodiments of the invention are disclosed. In a first embodiment, a magnetic sleeve is disposed so as to surround a coil winding of the inductor. In a second embodiment, a magnetic sleeve is epoxied over the coil winding. In a third embodiment, the magnetic sleeve is epoxied over a premold of the inductor.

The invention provides a solution to a further problem encountered in the fabrication of a shielded inductor. The problem relates to the failure, during fabrication of inductors, to achieve consistency in the axial and/or radial positioning of the shield with respect to the coil winding. In accordance with the present invention, a premold of the inductor is specially designed so as to enclose the coil winding and the axial leaded form of the inductor, to center the shield concentrically around the coil winding, and to position the shield properly along the axis of the coil winding.

Therefore, it is a primary object of the present invention to provide a shielded inductor and method for fabricating same.

It is an additional object of the present invention to provide a shielded inductor employing a magnetic sleeve formed of magnetic shielding material.

It is an additional object of the present invention to provide a premold of an inductor, the premold being specially designed so as to achieve, during fabrication of inductors, consistency in the axial and radial positioning of the magnetic shield relative to the coil winding.

The above and other objects, as will hereinafter appear, and the nature of the invention will be more clearly understood by reference to the following detailed description, the appended claims, and the drawings.

BEST MODE FOR CARRYING OUT THE INVENTION

The invention will now be more clearly understood by reference to the drawings.

Figure 1:
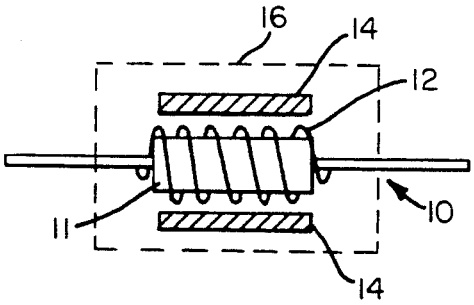
FIG. 1 illustrates a first embodiment of the shielded inductor of the present invention.

FIG. 1 illustrates a first embodiment of the shielded inductor of the present invention. As seen therein, a shielded inductor 10 comprises an axial leaded form 11, on which a coil winding 12 is wound. A magnetic sleeve 14 is disposed around the axial leaded form 11 and coil winding 12 so that the latter two elements are concentrically disposed within the magnetic sleeve 14. The magnetic sleeve 14 is, thus, preferably generally cylindrical in form so as to completely enclose the form 11 and coil winding 12. The outline of a finished mold 16 is shown by a broken line in FIG. 1.

The axial leaded form 11 basically serves as a holder for the lead wires at each end of the form 11, and as a holder for the conductive coil winding 12 itself. The leaded form 11 may or may not be of a high-magnetic, permeable material.

The magnetic sleeve 14 is, preferably, composed of a high, permeable, magnetic material.

The finished mold 16 is formed by final encapsulation of the aforementioned elements in an encapsulation material, preferably an insulating material. In a preferred embodiment of the invention, the encapsulating material is a moldable, heat-cured epoxy.

Figure 2:
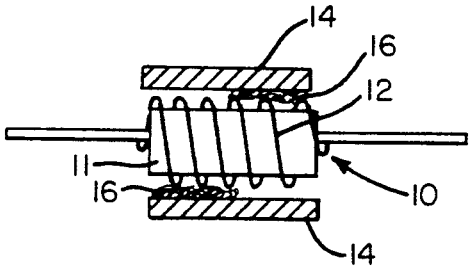
FIG. 2 illustrates a second embodiment of the shielded inductor of the present invention.

FIG. 2 illustrates a second embodiment of the shielded inductor of the present invention. In FIG. 2, reference numerals identical to those employed in FIG. 1 have been utilized where appropriate. As seen in FIG.

2, typically and preferably, the shield 14 is epoxied over the coil winding 12. The epoxy is indicated by reference numeral 16 in FIG. 2. Preferably, the epoxy 16 is composed of a high-strength, insulating material.

Figure 3:
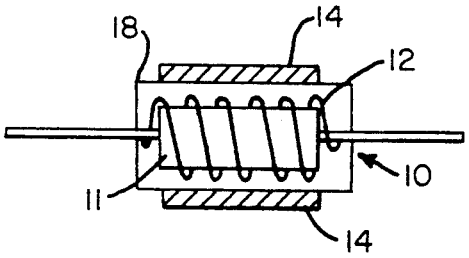
FIG. 3 illustrates a third embodiment of the shielded inductor of the present invention.

FIG. 3 illustrates a third embodiment of the shielded inductor of the present invention. Again, reference numerals identical to those previously employed have been utilized where appropriate. As indicated in FIG. 3, typically and preferably, magnetic shield 14 is epoxied over a premold 18 in those instances where a premold 18 is used to contain the axial leaded form 11 and coil winding 12.

As mentioned above, a problem encountered in the fabrication of an inductor, and especially in the fabrication of a shielded inductor, relates to the maintenance of uniformity in the inductance values of the resulting inductors. In the case of providing magnetic shielding for an inductor, the degree of magnetic shielding must be held to very tight standards in order to achieve uniformity in the inductance of the resulting shielded inductor. Both the inductance of the inductor and the degree of magnetic shielding provided by the magnetic shield will vary as the positioning of the magnetic shield 14 relative to the coil winding 12 varies during fabrication.

With this in mind, the present invention provides for a specially designed premold 18, the special design of the premold 18 permitting the manufacturer to assembly the shielded inductor rapidly while still maintaining tight standards and very little variation in the radial positioning of the magnetic shield 14 relative to the coil winding 12, that is, in the distance between the latter two elements. Thus, the invention calls for the use of a premold 18 surrounding the leaded form 11 and coil winding 12, the thickness of the premold 18 being such as to maintain the leaded form 11 and coil winding 12 uniformly centered relative to the surrounding magnetic sleeve 14.

Figure 4:
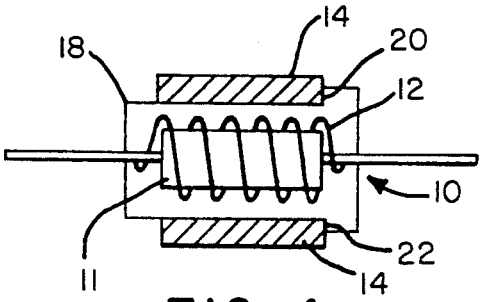
FIG. 4 illustrates a fourth embodiment of the shielded inductor of the present invention, including the provision of a specially designed premold for positioning the magnetic shielding both radially and axially relative to a winding coil of the shielded inductor.

FIG. 4 is an illustration of a fourth embodiment of the shielded inductor of the present invention. Again, where appropriate, reference numerals identical to those previously employed have been utilized. In the embodiment of FIG. 4, the premold 18 is provided with a shoulder 20 on its outer surface, the shoulder 20 acting to position the magnetic sleeve 14 in a proper position relative to and along the axis of the coil winding 12. In this manner, the proper amount of magnetic shielding 14 is provided relative to the leaded form 11 and coil winding 12 of the shielded inductor 10.

While preferred forms and arrangements have been shown above in illustrating the invention, it is to be understood that various changes and modifications may be made without departing from the spirit and scope of this disclosure.

I claim:

1. A shielded inductor comprising:

an axial form having a longitudinal axis;

a coil of wire wound about said axial form;

cylindrical magnetic shield means extending in a direction parallel to said axis and surrounding said axial form and said coil of wire for providing magnetic shielding to said axial form and to said coil of wire;

positioning means surrounding said axial form and said coil of wire and disposed between said coil of wire and said magnetic shield means for positioning said magnetic shield means with respect to said coil of wire during assembly of said shielded inductor;

said positioning means comprising a cylindrical plastic pre-mold surrounding and encapsulating said coil and said axial form;

a first diameter extending along the entire extent of said premold, except for a shoulder portion at one end, being substantially the same as the internal diameter of said cylindrical magnetic shield means;

said shoulder portion being of single-piece construction with said premold and having a greater diameter than said first diameter; said shoulder portion positioning said magnetic shield means along the axis of said axial form.

* * * * *